US011054139B2

(12) United States Patent
Patel et al.

(10) Patent No.: US 11,054,139 B2
(45) Date of Patent: Jul. 6, 2021

(54) HYBRID AIR BLAST FUEL NOZZLE

(71) Applicant: General Electric Company, Schenectady, NY (US)

(72) Inventors: Nayan Vinodbhai Patel, Liberty Township, OH (US); Duane Douglas Thomsen, Lebanon, OH (US)

(73) Assignee: General Electric Company, Schenectady, NY (US)

( * ) Notice: Subject to any disclaimer, the term of this patent is extended or adjusted under 35 U.S.C. 154(b) by 433 days.

(21) Appl. No.: 15/907,978

(22) Filed: Feb. 28, 2018

(65) Prior Publication Data

US 2018/0187892 A1 Jul. 5, 2018

Related U.S. Application Data

(62) Division of application No. 14/643,335, filed on Mar. 10, 2015, now Pat. No. 9,939,157.

(51) Int. Cl.

| | |
|---|---|
| ***F23R 3/28*** | (2006.01) |
| ***F23R 3/34*** | (2006.01) |
| ***F23D 11/24*** | (2006.01) |

(52) U.S. Cl.

CPC ..... *F23R 3/286* (2013.01); *F23D 11/24* (2013.01); *F23R 3/28* (2013.01); *F23R 3/343* (2013.01); *F23D 2900/00015* (2013.01); *F23D 2900/11101* (2013.01)

(58) Field of Classification Search

CPC .. F23R 3/28; F23R 3/286; F23R 3/343; F23R 3/346; F23D 11/24; F23D 2900/00015; F23D 2900/11101

See application file for complete search history.

(56) References Cited

U.S. PATENT DOCUMENTS

| | | | | |
|---|---|---|---|---|
| 3,866,413 | A | 2/1975 | Sturgess | |
| 4,139,157 | A | 2/1979 | Simmons | |
| 4,815,664 | A * | 3/1989 | Tuthill | F23D 11/107 239/404 |
| 6,272,840 | B1 | 8/2001 | Crocker et al. | |
| 6,363,726 | B1 | 4/2002 | Durbin et al. | |

(Continued)

FOREIGN PATENT DOCUMENTS

| | | |
|---|---|---|
| EP | 1045202 | 10/2000 |
| EP | 1767851 | 3/2007 |

(Continued)

*Primary Examiner* — Arun Goyal

(74) *Attorney, Agent, or Firm* — Dinsmore & Shohl LLP

(57) ABSTRACT

A fuel nozzle apparatus for a gas turbine engine includes: a first pilot fuel injector disposed on a centerline axis of the fuel nozzle which defines a direction of air flow through the fuel nozzle, the first pilot fuel injector being of a pressure atomizing type; an annular second pilot fuel injector at least partially surrounding the first pilot fuel injector, the second pilot fuel injector being of an air blast type and having a fuel outlet disposed axially downstream and radially outboard of the first pilot fuel injector; an annular venturi surrounding the first and second pilot fuel injectors, the venturi including a throat of minimum diameter; an array of inner swirl vanes extending between the first pilot fuel injector and the second pilot fuel injector; and an array of outer swirl vanes extending between the second pilot fuel injector and the venturi.

4 Claims, 3 Drawing Sheets

(56) References Cited

U.S. PATENT DOCUMENTS

| | | | | |
|---|---|---|---|---|
| 6,547,163 | B1 | 4/2003 | Mansour et al. | |
| 7,878,000 | B2 | 2/2011 | Mancini et al. | |
| 8,096,135 | B2 | 1/2012 | Caples | |
| 8,387,391 | B2 * | 3/2013 | Patel | F23R 3/28 60/740 |
| 8,806,871 | B2 | 8/2014 | McMasters et al. | |
| 8,943,829 | B2 | 2/2015 | Bagchi et al. | |
| 9,188,341 | B2 | 11/2015 | McMasters et al. | |
| 9,404,658 | B2 | 8/2016 | Nickolaus | |
| 9,513,009 | B2 * | 12/2016 | Williams | F23D 11/107 |
| 2009/0256007 | A1 | 10/2009 | McMasters et al. | |
| 2010/0269506 | A1 | 10/2010 | Nonaka et al. | |
| 2011/0289933 | A1 | 12/2011 | Boardman et al. | |
| 2016/0281991 | A1 | 9/2016 | Rullaud et al. | |

FOREIGN PATENT DOCUMENTS

| | | |
|---|---|---|
| EP | 1767852 | 3/2007 |
| EP | 1767853 | 3/2007 |

* cited by examiner

HYBRID AIR BLAST FUEL NOZZLE

CROSS-REFERENCE TO RELATED APPLICATION

This application is a divisional of U.S. application Ser. No. 14/643,335, filed on Mar. 10, 2015 and entitled HYBRID AIR BLAST FUEL NOZZLE, which is hereby expressly incorporated herein by reference in its entirety.

BACKGROUND OF THE INVENTION

The present invention relates to gas turbine engine fuel nozzles and, more particularly, to pilot fuel injectors of engine fuel nozzles.

Aircraft gas turbine engines include a combustor in which fuel is burned to input heat to the engine cycle. Typical combustors incorporate one or more fuel injectors whose function is to introduce liquid fuel into an air flow stream so that it can atomize and burn.

Staged combustors have been developed to operate with low pollution, high efficiency, low cost, high engine output, and good engine operability. In a staged combustor, the nozzles of the combustor are operable to selectively inject fuel through two or more discrete stages, each stage being defined by individual fuel flowpaths within the fuel nozzle. For example, the fuel nozzle may include one or more pilot stages, and a main stage that only operates at higher engine power levels. The fuel flowrate may also be variable within each of the stages.

The main stage includes an annular main injection ring having a plurality of fuel injection ports which discharge fuel through a surrounding centerbody into a swirling mixer airstream.

Known types of pilot fuel injector structures include pressure atomizer fuel injectors and air blast fuel injectors.

Prior art designs have used two-stage pilots with both stages being pressure atomizers. This configuration allows for good lightoff/starting performance owing to its small flow number pilot primary tip and good flow range owing to its larger pilot secondary. However, the close coupling of these circuits means that for all intents and purposes they are only a single fuel stream when both are flowing and provide no capability for flame temperature control. Furthermore, the pilot secondary flow actually disrupts the pilot primary atomization resulting in poor sub-idle efficiency.

Other prior art designs have used a prefilming air blast (PAB) pilot which provides better atomization performance than a pilot secondary pressure atomizer.

Accordingly, there remains a need for a pilot fuel injector with both good lightoff capability and a secondary that does not interfere with primary atomization as it is brought into operation.

BRIEF DESCRIPTION OF THE INVENTION

This need is addressed by the present invention, which provides a fuel nozzle incorporating a pressure-atomizer pilot primary fuel injector and an air blast pilot secondary fuel injector that is spatially separated from the pilot primary fuel injector. The structure that provides this functional arrangement is referred to herein as a "hybrid air blast" fuel nozzle.

According to one aspect of the invention, a fuel nozzle apparatus for a gas turbine engine includes: a first pilot fuel injector disposed on a centerline axis of the fuel nozzle which defines a direction of air flow through the fuel nozzle, the first pilot fuel injector being of a pressure atomizing type; an annular second pilot fuel injector at least partially surrounding the first pilot fuel injector, the second pilot fuel injector being of an air blast type and having a fuel outlet disposed axially downstream and radially outboard of the first pilot fuel injector; an annular venturi surrounding the first and second pilot fuel injectors, the venturi including a throat of minimum diameter; an array of inner swirl vanes extending between the first pilot fuel injector and the second pilot fuel injector; and an array of outer swirl vanes extending between the second pilot fuel injector and the venturi.

According to another aspect of the invention, the second pilot fuel injector includes an annular fuel manifold defined therein which communicates with the fuel outlet.

According to another aspect of the invention, an annular inner heat shield is disposed radially inboard of the fuel manifold, separated from the fuel manifold by an air space.

According to another aspect of the invention, an annular outer heat shield is disposed radially outboard of the fuel manifold, separated from the fuel manifold by an air space.

According to another aspect of the invention, an array of mid swirl vanes is disposed radially between the fuel outlet and either the inner swirl vanes or the outer swirl vanes.

According to another aspect of the invention, at least some of the swirl vanes have a helical or partially-helical shape.

According to another aspect of the invention, the mid swirl vanes are disposed radially between the fuel outlet and the inner swirl vanes.

According to another aspect of the invention, the mid swirl vanes are disposed radially between the fuel outlet and the outer swirl vanes.

According to another aspect of the invention, the second pilot fuel injector includes an inner surface having, in axial sequence from front to rear: a generally cylindrical upstream section, a throat of minimum diameter, and a downstream diverging section.

According to another aspect of the invention, the fuel outlet intersects the diverging section of the inner surface.

According to another aspect of the invention, the second pilot fuel injector includes: an annular fuel manifold defined therein which communicates with the fuel outlet; an annular inner heat shield disposed radially inboard of the fuel manifold, separated from the fuel manifold by an air space; an annular outer heat shield disposed radially outboard of the fuel manifold, separated from the fuel manifold by an air space;

an annular inner wall disposed radially inboard of the inner heat shield, the inner wall defining the inner surface; and an array of mid swirl vanes extending between the inner heat shield and the inner wall.

According to another aspect of the invention, the second pilot fuel injector includes an outer surface having, in axial sequence from front to rear: a generally cylindrical upstream section, and a downstream converging section.

According to another aspect of the inventions, the second pilot fuel injector includes: an annular fuel manifold defined therein which communicates with the fuel outlet; an annular inner heat shield disposed radially inboard of the fuel manifold, separated from the fuel manifold by an air space; an annular outer heat shield disposed radially outboard of the fuel manifold, separated from the fuel manifold by an air space;

an annular outer wall disposed radially outboard of the outer heat shield, the outer wall defining the outer surface; and an array of mid swirl vanes extending between the outer heat shield and the outer wall.

According to another aspect of the invention, at least some of the vanes have a helical or partially-helical shape.

According to another aspect of the invention, a fuel nozzle apparatus includes: the fuel nozzle apparatus above; an annular outer body surrounding the pilot fuel injectors, the outer body extending parallel the centerline axis, the outer body having a generally cylindrical exterior surface extending between forward and aft ends, and having a plurality of openings passing through the exterior surface; an annular main injection ring disposed inside the outer body, the main injection ring including an annular array of main fuel orifices, each main fuel orifice being aligned with one of the openings in the outer body; and a main fuel gallery extending within the main injection ring in a circumferential direction and communication with the plurality of main fuel orifices.

According to another aspect of the invention, the apparatus further includes: a fuel system operable to supply a flow of liquid fuel at varying flowrates; a pilot primary fuel conduit coupled between the fuel system and the first pilot fuel injector; a pilot secondary fuel conduit coupled between the fuel system and the second pilot fuel injector; and a main fuel conduit coupled between the fuel system and the main injection ring.

BRIEF DESCRIPTION OF THE DRAWINGS

The invention may be best understood by reference to the following description, taken in conjunction with the accompanying drawing figures in which.

DETAILED DESCRIPTION OF THE INVENTION

Generally, the present invention provides a fuel nozzle with a main injection ring and a two-stage pilot fuel injector. The pilot fuel injector has two fuel circuits; namely a pressure atomization injector in a primary stage and an airblast injector for a secondary stage. Multiple variants are possible for positioning an atomizing air stream at different radial locations to optimize and tailor fuel-air profile at the pilot discharge.

Figure 1:
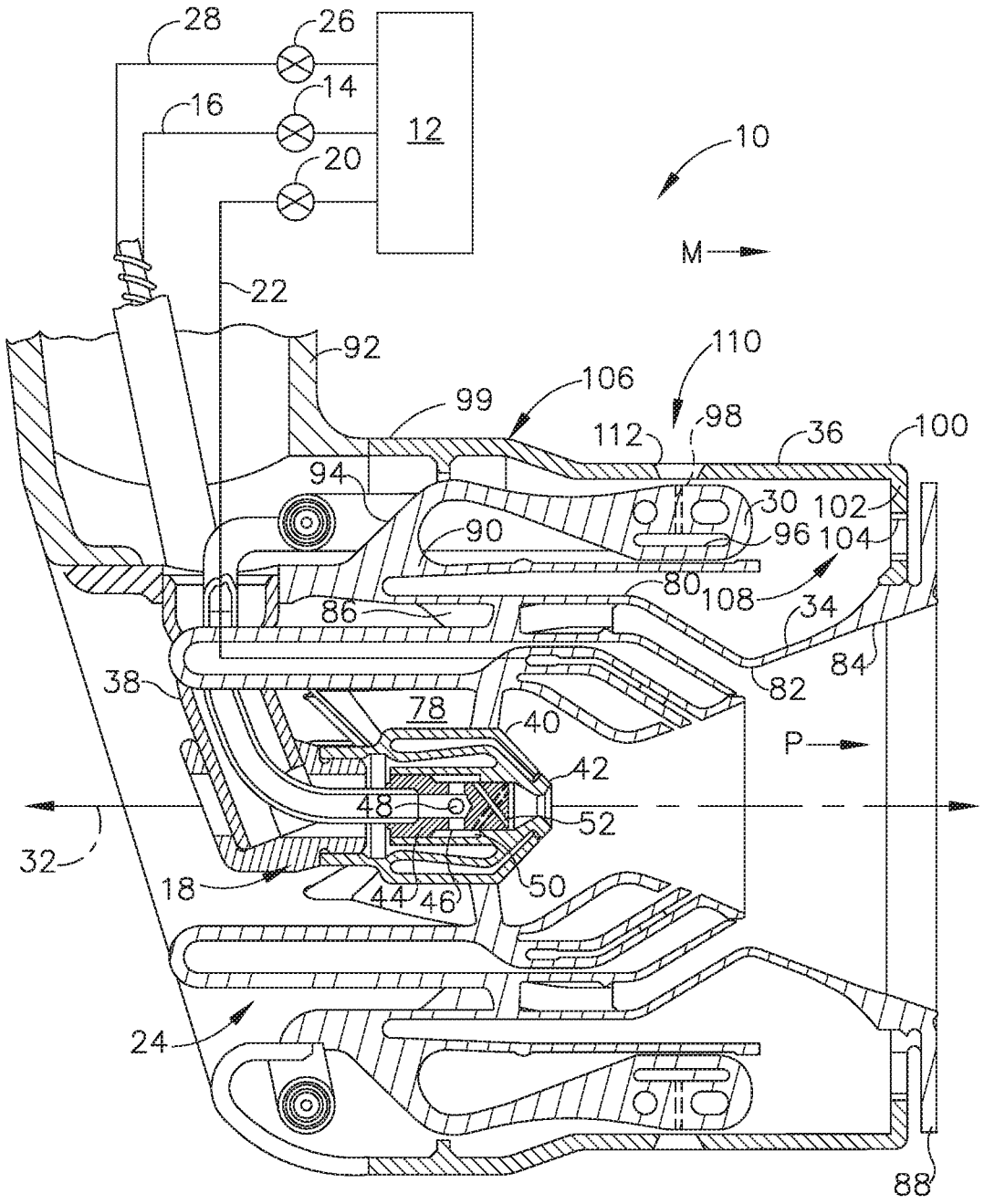
FIG. 1 is a schematic cross-sectional view of a gas turbine engine fuel nozzle constructed according to an aspect of the present invention.

Now, referring to the drawings wherein identical reference numerals denote the same elements throughout the various views, FIG. 1 depicts an exemplary fuel nozzle 10 of a type configured to inject liquid hydrocarbon fuel into an airflow stream of a gas turbine engine combustor (not shown). The fuel nozzle 10 is of a "staged" type meaning it is operable to selectively inject fuel through two or more discrete stages, each stage being defined by individual fuel flowpaths within the fuel nozzle 10. The fuel flowrate may also be variable within each of the stages. Each separately-controllable fuel flowpath may be referred to as a "stage" or "circuit" of the fuel nozzle 10.

The fuel nozzle 10 is connected to a fuel system 12 of a known type, operable to supply a flow of liquid fuel at varying flowrates according to operational need. The fuel system supplies fuel to a pilot primary control valve 14 which is coupled to a pilot primary fuel conduit 16, which in turn supplies fuel to a pilot primary fuel injector 18 of the fuel nozzle 10. (The pilot primary fuel injector 18 may also be referred to herein as a "first pilot fuel injector" or simply "first pilot injector"). The fuel system supplies fuel to a pilot secondary control valve 20 which is coupled to a pilot secondary fuel conduit 22, which in turn supplies fuel to a pilot secondary fuel injector 24 of the fuel nozzle 10. (The pilot secondary fuel injector 24 may also be referred to herein as a "second pilot fuel injector" or simply "second pilot injector"). The fuel system 12 also supplies fuel to a main control valve 26 which is coupled to a main fuel conduit 28, which in turn supplies a main injection ring 30 of the fuel nozzle 10. In FIG. 1 the fuel conduits are shown as single lines, with the understanding that each line may represent one or more tubes, pipes, or internal passages configured to transport liquid fuel from one point to another.

For purposes of description, reference will be made to a centerline axis 32 of the fuel nozzle 10 which is generally parallel to a centerline axis of the engine (not shown) in which the fuel nozzle 10 would be used. As used herein, the terms "axial", "longitudinal", "forward", or "aft", all refer to directions, flow, or movement parallel to the centerline axis 32, and terms "radial", "inboard", and "outboard" refer to directions, flow or movement perpendicular to the centerline axis 32. The major components of the illustrated fuel nozzle 10 are disposed extending parallel to and surrounding the centerline axis 32, generally as a series of concentric rings. Starting from the centerline axis 32 and proceeding radially outward, the major components are: the pilot primary fuel injector 18, the pilot secondary fuel injector 24, a venturi 34, the main injection ring 30, and an outer body 36. Each of these structures will be described in detail.

The pilot primary fuel injector 18 is disposed at an upstream end of the fuel nozzle 10, aligned with the centerline axis 32 and surrounded by a fairing 38.

The illustrated pilot primary fuel injector 18 includes a generally cylindrical, axially-elongated, pilot centerbody 40. An upstream end of the pilot centerbody 40 is connected to the fairing 38. The downstream end of the pilot fuel injector 18 includes a converging-diverging discharge orifice 42 with a conical exit.

A metering plug 44 is disposed within a central bore 46 of the pilot fuel injector 18. The metering plug 44 communicates with the pilot primary fuel conduit 16. The metering plug 44 includes transfer holes 48 that flow fuel to a feed annulus 50 defined between the metering plug 44 and the central bore 46, and also includes an array of angled spray holes 52 arranged to receive fuel from the feed annulus 50 and flow it towards the discharge orifice 42 in a swirling pattern, with a tangential velocity component.

The pilot primary fuel injector 18 is a of a type referred to as a "pressure atomizer" in which fuel is atomized by action of liquid fuel being discharged through a small orifice across a significant pressure differential (or pressure drop). This type of fuel injector is characterized by a relatively low flow number. It will be understood that the flow number of a fuel injector is a parameter which is calculated by the mass flow rate divided by the square root of the pressure differential, i.e. flow number=$Wf/\sqrt{\Delta p}$, wherein Wf=fuel mass flow rate and $\Delta p$=pressure differential). Other types of pressurized atomizer fuel injectors could be substituted for the specific configuration illustrated.

The pilot secondary fuel injector 24 is an annular structure disposed outboard of the pilot primary fuel injector 18, concentric with the centerline axis 32.

Figure 2:
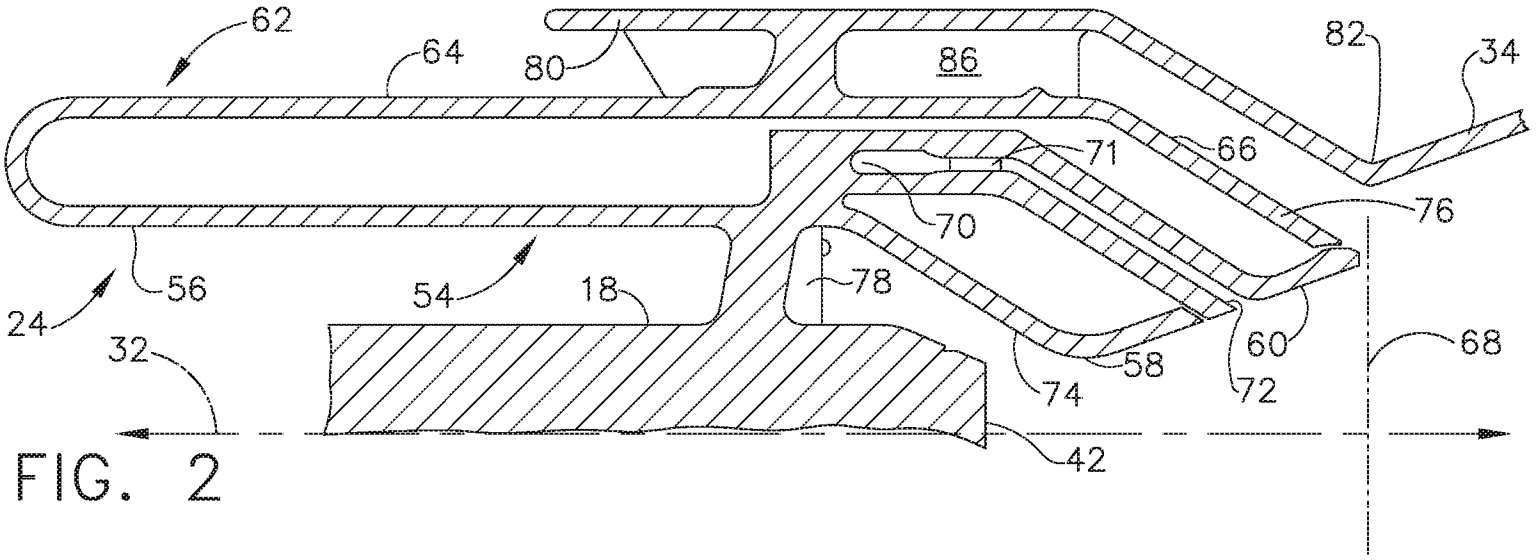
FIG. 2 is an enlarged view of a portion of the fuel nozzle of FIG. 1, showing a pilot secondary fuel injection structure thereof.

As seen in FIGS. 1 and 2, the pilot secondary fuel injector 24 has an inner surface 54 which includes, in axial sequence: a generally cylindrical upstream section 56, a throat 58 of minimum diameter, and a downstream diverging section 60. The upstream section 56 surrounds the pilot primary fuel injector 18, and the throat 58 is positioned axially downstream of the pilot primary fuel injector 18. The pilot secondary fuel injector 24 also has an outer surface 62 which includes, in axial sequence: a generally cylindrical upstream section 64, and a downstream converging section 66. The inner and outer surfaces 54, 62 terminate at a common exit plane 68.

The pilot secondary fuel injector 24 includes internal walls and/or passages defining a fuel manifold 70. The fuel manifold 70 may incorporate fuel swirl vanes 71 which are shaped and oriented to induce a tangential component of velocity (i.e. "swirl") into fuel flow passing through the fuel manifold 70. A downstream end of the fuel manifold 70 terminates in an annular fuel outlet 72 which intersects the diverging section 60 of the inner surface 54. An upstream end of the fuel manifold 70 communicates with the pilot secondary fuel conduit 22 (seen in FIG. 1). The fuel outlet 72 is positioned axially downstream of and radially outboard of the discharge orifice 42 of the pilot primary fuel injector 18.

The pilot secondary fuel injector 24 may include one or more heat shields in the form of thin walls separated from adjacent structure by an air space. The purpose of the heat shields is to protect the liquid fuel in the fuel manifold 70 from excessive heating and possible coking. In the illustrated example, the pilot secondary fuel injector 24 incorporates an annular inner heat shield 74 radially inboard of the fuel manifold 70 and adjacent the inner surface 54, and an annular outer heat shield 76 outboard of the fuel manifold 70 and adjacent the outer surface 62.

The pilot secondary fuel injector 24 is of a type referred to as a "air blast" in which fuel is atomized by blasting air at the fuel. In this type of fuel injector, the kinetic energy of the air stream is utilized instead of relying on the hydraulic energy of the fuel stream at low flowrates. This type of fuel injector is characterized by a relatively higher flow number. Other types of air blast fuel injectors could be substituted for the specific configuration illustrated.

An inner air swirler comprises a radial array of inner swirl vanes 78 which extend between the pilot centerbody 40 and the upstream section 56 of the inner surface 54 of the pilot secondary fuel injector 24. The inner swirl vanes 78 are shaped and oriented to induce a tangential component of velocity (i.e. "swirl") into air flow passing through the inner air swirler. The inner swirl vanes 78 may be airfoil-shaped and may have a helical or partially-helical shape.

The annular venturi 34 surrounds the pilot secondary fuel injector 24. It includes, in axial sequence: a generally cylindrical upstream section 80, a throat 82 of minimum diameter, and a downstream diverging section 84. The throat 82 is axially aligned with the exit plane 68 of the inner surface 54 of the pilot secondary fuel injector 24.

A radial array of outer swirl vanes 86 defining an outer air swirler extends between the pilot secondary fuel injector 24 and the venturi 34. The outer swirl vanes 86 are shaped and oriented to induce a swirl into air flow passing through the outer air swirler. The outer swirl vanes 86 may be airfoil-shaped and may have a helical or partially-helical shape. The bore of the venturi 34 defines a flowpath for a pilot air flow, generally designated "P", through the fuel nozzle 10.

Referring back to FIG. 1, an aft heat shield 88 in the form of an annular, radially-extending plate may be disposed at an aft end of the diverging section 84 of the venturi 34.

The annular main ring support 90 surrounds the venturi 34. The main ring support 90 may be connected to the fairing 38 and serve as a mechanical connection between the main injection ring 30 and stationary mounting structure such as a fuel nozzle stem, a portion of which is shown as item 92.

The main injection ring 30 which is annular in form surrounds the venturi 34. It may be connected to the main ring support 90 by one or more main support arms 94.

The main injection ring 30 includes a main fuel gallery 96 extending in a circumferential direction which is coupled to and supplied with fuel by the main fuel conduit 28. A radial array of main fuel orifices 98 formed in the main injection ring 30 communicate with the main fuel gallery 96. During engine operation, fuel is discharged through the main fuel orifices 98.

The annular outer body 36 surrounds the main injection ring 30, venturi 34, and pilot fuel injectors 18 and 24, and defines the outer extent of the fuel nozzle 10. A forward end 99 of the outer body 36 is joined to the stem 92 when assembled (see FIG. 1). An aft end 100 of the outer body 36 may include an annular, radially-extending baffle 102 incorporating cooling holes 104 directed at the aft heat shield 88. Extending between the forward and aft ends is a generally cylindrical exterior surface 106 which in operation is exposed to a mixer airflow, generally designated "M." The outer body 36 defines a secondary flowpath 108, in cooperation with the venturi 34. Air passing through this secondary flowpath 108 is discharged through the cooling holes 104.

The outer body 36 includes an annular array of recesses referred to as "spray wells" 110. Each of the spray wells 110 is defined by an opening 112 in the outer body 36 in cooperation with the main injection ring 30. Each of the main fuel orifices 98 is aligned with one of the spray wells 110.

The fuel nozzle 10 and its constituent components may be constructed from one or more metallic alloys. Nonlimiting examples of suitable alloys include nickel and cobalt-based alloys.

All or part of the fuel nozzle 10 or portions thereof may be part of a single unitary, one-piece, or monolithic component, and may be manufactured using a manufacturing process which involves layer-by-layer construction or additive fabrication (as opposed to material removal as with conventional machining processes). Such processes may be referred to as "rapid manufacturing processes" and/or "additive manufacturing processes," with the term "additive manufacturing process" being the term used herein to refer generally to such processes. Additive manufacturing processes include, but are not limited to: Direct Metal Laser Melting (DMLM), Laser Net Shape Manufacturing (LNSM), electron beam sintering, Selective Laser Sintering (SLS), 3D printing, such as by inkjets and laserjets, Sterolithography (SLS), Electron Beam Melting (EBM), Laser Engineered Net Shaping (LENS), and Direct Metal Deposition (DMD).

In operation, liquid fuel is discharged from the pilot primary fuel injector 18, pilot secondary fuel injector 24, and the main injection ring 30, and atomizes. It subsequently ignites and burns, releasing heat energy. The fuel flow rate in each stage of the fuel nozzle 10 may be infinitely variable between zero flow and the maximum value for that stage or circuit. For any given total fuel flow, the relative fuel flow of each stage or circuit, or the "flow split", may be varied to suit specific operating requirements and desires.

By providing physical separation between the pilot primary fuel injector 18 and the pilot secondary fuel injector 24, the fuel nozzle 10 provides an additional independent variable or "lever" which can be varied for the purpose of flame temperature control.

The inclusion of the pilot primary fuel injector 18 with a low flow number provides enhanced and controlled fuel atomization at all engine light-off/starting conditions, specifically at low engine air flows or at high altitude. This feature primarily impacts engine light-off and combustion efficiency during starts.

Furthermore, the use of air blast atomization in the pilot secondary fuel injector 24 provides better control of secondary atomization, especially during minimal-flow or "dribble" type conditions. In addition, air blast atomization provides enhanced flow capability for the pilot secondary fuel injector 24 to mitigate transient engine operations. Physical separation from the pilot primary fuel injector also prevents potential spoilage of primary atomization by "lazy" secondary flow.

Figure 3:
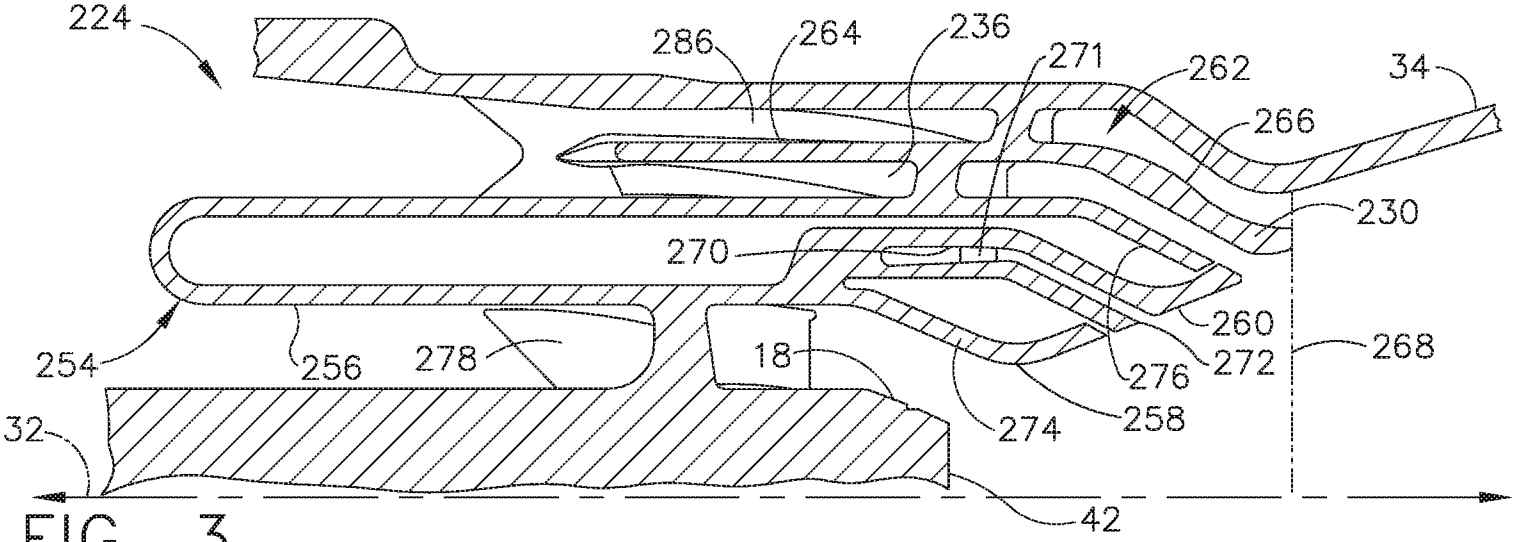
FIG. 3 is a cross-sectional view of an alternative pilot secondary fuel injection structure.

FIG. 3 illustrates an alternative pilot secondary fuel injector 224. It will be understood that the pilot secondary fuel injector 224 could be substituted for the pilot secondary fuel injector 24 described above, while generally maintaining the same surrounding structures of the fuel nozzle 10 as described above.

The pilot secondary fuel injector 224 is an annular structure disposed outboard of the pilot primary fuel injector 18 (shown schematically in FIG. 3), concentric with the centerline axis 32.

The pilot secondary fuel injector 224 has an inner surface 254 which includes, in axial sequence, from front to rear: a generally cylindrical upstream section 256, a throat 258 of minimum diameter, and a downstream diverging section 260. The upstream section 256 surrounds the pilot primary fuel injector 18, and the throat 258 is positioned axially downstream of the pilot primary fuel injector 18. The pilot secondary fuel injector 224 also has an outer surface 262 which includes, in axial sequence, from front to rear: a generally cylindrical upstream section 264, and a downstream converging section 266. The inner and outer surfaces 254, 262 terminate at a common exit plane 268.

The pilot secondary fuel injector 224 includes internal walls and/or passages defining a fuel manifold 270. The fuel manifold 270 may incorporate fuel swirl vanes 271 which are shaped and oriented to induce a tangential component of velocity (i.e. "swirl") into fuel flow passing through the fuel manifold 270. A downstream end of the fuel manifold 270 terminates in an annular fuel outlet 272 which intersects the diverging section 260 of the inner surface 254. An upstream end of the fuel manifold 270 communicates with the pilot secondary fuel conduit 22 (seen in FIG. 1). The fuel outlet 272 is positioned axially downstream of and radially outboard of the discharge orifice 42 of the pilot primary fuel injector 18.

The pilot secondary fuel injector 224 may include one or more heat shields in the form of thin walls separated from adjacent structure by an air space. The purpose of the heat shields is to protect the liquid fuel in the fuel manifold 270 from excessive heating and possible coking. In the illustrated example, the pilot secondary fuel injector 224 incorporates an annular inner heat shield 274 inboard of the fuel conduit 270, and an annular outer heat shield 276 outboard of the fuel conduit 270. The inner heat shield 274 defines a portion of the inner surface 254 described above.

An annular outer wall 230 is disposed between the outer heat shield 276 and the venturi 34. The outer wall 230 defines the outer surface 262 described above.

A radial array of mid swirl vanes 236 defining a mid air swirler extends between the outer heat shield 276 and the outer wall 230. The mid swirl vanes 236 are shaped and oriented to induce a swirl into air flow passing through the mid air swirler. The mid swirl vanes 236 may be airfoil-shaped and may have a helical or partially-helical shape.

A radial array of outer swirl vanes 286 defining an outer air swirler extends between the outer wall 230 and the venturi 34. The outer swirl vanes 286 are shaped and oriented to induce a swirl into air flow passing through the outer air swirler. The outer swirl vanes 286 may be airfoil-shaped and may have a helical or partially-helical shape.

An inner air swirler comprises a radial array of inner swirl vanes 278 which extend between the pilot primary fuel injector 18 and the upstream section 256 of the inner surface 254 of the pilot secondary fuel injector 224. The inner swirl vanes 278 are shaped and oriented to induce a swirl into air flow passing through the inner air swirler. The inner swirl vanes 278 may be airfoil-shaped and may have a helical or partially-helical shape.

In this embodiment, the fuel flow from the fuel manifold 270 is surrounded by three pilot air flows (on inboard and two outboard), as opposed to the two pilot air flows of the pilot secondary fuel injector 24 shown in FIGS. 1 and 2. The additional outermost air flow is useful in preventing fuel from contacting the venturi 34.

Figure 4:
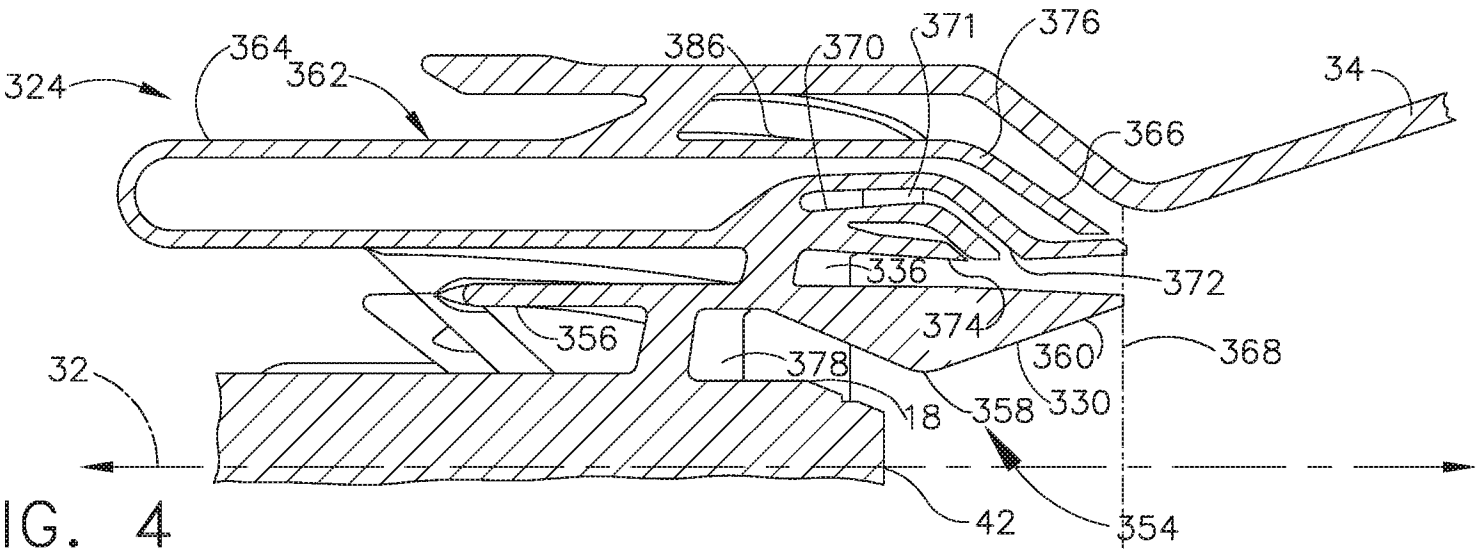
FIG. 4 is a cross-sectional view of another alternative pilot secondary fuel injection structure.

FIG. 4 illustrates another alternative pilot secondary fuel injector 324. It will be understood that the pilot secondary fuel injector 324 could be substituted for the pilot secondary fuel injector 24 described above, while generally maintaining the same surrounding structures of the fuel nozzle 10 as described above.

The pilot secondary fuel injector 324 is an annular structure disposed outboard of the pilot primary fuel injector 18 (shown schematically in FIG. 4), concentric with the centerline axis 32.

The pilot secondary fuel injector 324 has an inner surface 354 which includes, in axial sequence, from front to rear: a generally cylindrical upstream section 356, a throat 358 of minimum diameter, and a downstream diverging section 360. The upstream section 356 surrounds the pilot primary fuel injector 18, and the throat 358 is positioned axially downstream of the pilot primary fuel injector 18. The pilot secondary fuel injector 324 also has an outer surface 362 which includes, in axial sequence, from front to rear: a generally cylindrical upstream section 364, and a downstream converging section 366. The inner and outer surfaces 354, 362 terminate at a common exit plane 368.

The pilot secondary fuel injector 324 includes internal walls and/or passages defining a fuel manifold 370. The fuel manifold 370 may incorporate fuel swirl vanes 371 which are shaped and oriented to induce a tangential component of velocity (i.e. "swirl") into fuel flow passing through the fuel manifold 370. A downstream end of the fuel manifold 370 terminates in an annular fuel outlet 372 which communicates with a junction of the diverging section 360 of the inner surface 354 and the outer surface 362. An upstream end of the fuel manifold 370 communicates with the pilot secondary fuel conduit 22. The fuel outlet 372 is positioned axially downstream of and radially outboard of the discharge orifice 42 of the pilot primary fuel injector 18.

The pilot secondary fuel injector 324 may include one or more heat shields in the form of thin walls separated from adjacent structure by an air space. The purpose of the heat shields is to protect the liquid fuel in the fuel manifold 370 from excessive heating and possible coking. In the illustrated example, the pilot secondary fuel injector 324 incorporates an annular inner heat shield 374, and an annular outer heat shield 376 radially outboard of the inner heat shield 374. The outer heat shield 376 defines the outer surface 362.

An annular inner wall 330 is disposed radially inboard of the inner heat shield 374. The inner wall 330 defines the inner surface 354.

A radial array of mid swirl vanes 336 defining a mid air swirler extends between the inner wall 330 and the inner heat shield 374. The mid swirl vanes 336 are shaped and oriented to induce a swirl into air flow passing through the mid air swirler. The mid swirl vanes 336 may be airfoil-shaped and may have a helical or partially-helical shape.

A radial array of outer swirl vanes 386 defining an outer air swirler extends between the outer surface 362 and the venturi 34. The outer swirl vanes 386 are shaped and oriented to induce a swirl into air flow passing through the outer air swirler. The outer swirl vanes 386 may be airfoil-shaped and may have a helical or partially-helical shape.

An inner air swirler comprises a radial array of inner swirl vanes 378 which extend between the pilot primary fuel injector 18 and the upstream section 356 of the inner surface 354 of the pilot secondary fuel injector 324. The inner swirl vanes 378 are shaped and oriented to induce a swirl into air flow passing through the inner air swirler. The inner swirl vanes 378 may be airfoil-shaped and may have a helical or partially-helical shape.

In this embodiment, the fuel flow from the fuel manifold 370 is surrounded by three pilot air flows (two inboard of the fuel manifold 370 and one outboard of the fuel manifold 370), as opposed to the two pilot air flows of the pilot secondary fuel injector 24 shown in FIGS. 1 and 2. The additional innermost air flow is useful in minimizing interaction of fuel sprays from the pilot primary fuel injector 18 and the pilot secondary fuel injector 324.

Figure 5:
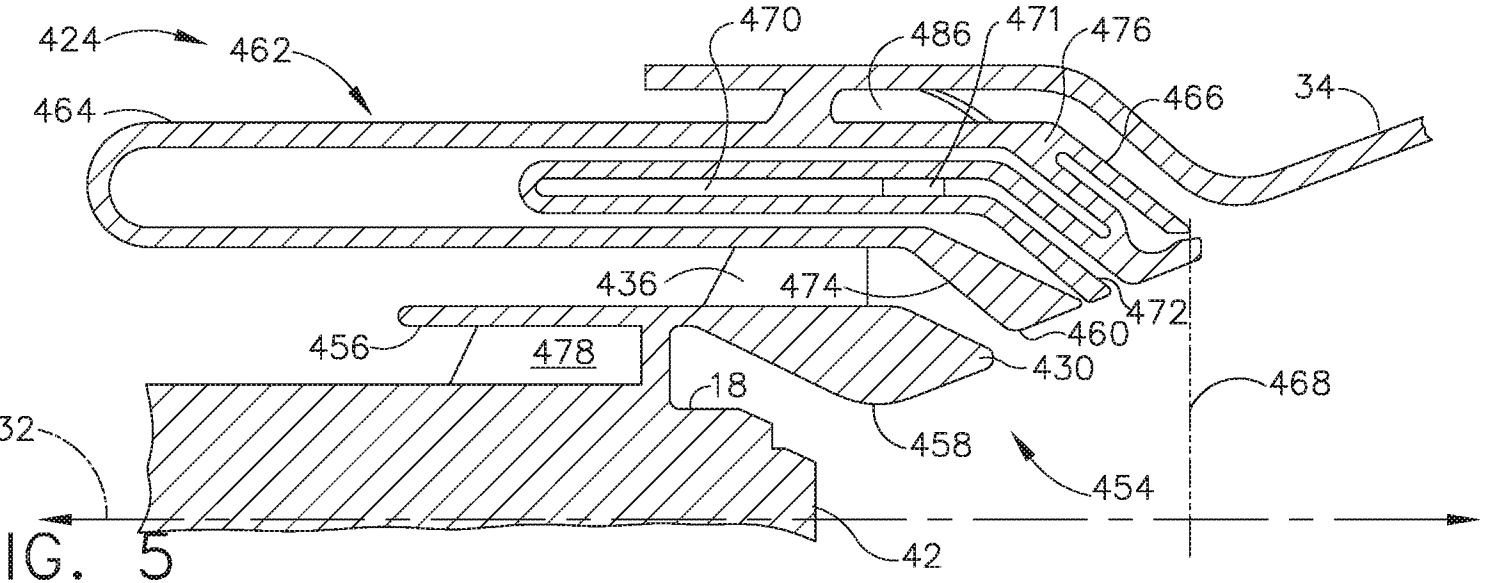
FIG. 5 is a cross-sectional view of another alternative pilot secondary fuel injection structure.

FIG. 5 illustrates another alternative pilot secondary fuel injector 424. It will be understood that the pilot secondary fuel injector 424 could be substituted for the pilot secondary fuel injector 24 described above, while generally maintaining the same surrounding structures of the fuel nozzle 10 as described above. The pilot secondary fuel injector 424 is similar in construction to the pilot secondary fuel injector 324 shown in FIG. 4.

The pilot secondary fuel injector 424 is an annular structure disposed outboard of the pilot primary fuel injector 18 (shown schematically in FIG. 5), concentric with the centerline axis 32.

The pilot secondary fuel injector 424 has an inner surface 454 which includes, in axial sequence, from front to rear: a generally cylindrical upstream section 456, a throat 458 of minimum diameter, and a downstream diverging section 460. The upstream section 456 surrounds the pilot primary fuel injector 18, and the throat 458 is positioned axially downstream of the pilot primary fuel injector 18. The pilot secondary fuel injector 424 also has an outer surface 462 which includes, in axial sequence, from front to rear: a generally cylindrical upstream section 464, and a downstream converging section 466. The inner and outer surfaces 454, 462 terminate at a common exit plane 468.

The pilot secondary fuel injector 424 includes internal walls and/or passages defining a fuel manifold 470. The fuel manifold 470 may incorporate fuel swirl vanes 471 which are shaped and oriented to induce a tangential component of velocity (i.e. "swirl") into fuel flow passing through the fuel manifold 470. A downstream end of the fuel manifold 470 terminates in an annular fuel outlet 472 which intersects the diverging section 460 of the inner surface 454. An upstream end of the fuel manifold 470 communicates with the pilot secondary fuel conduit 22. The fuel outlet 472 is positioned axially downstream of and radially outboard of the discharge orifice 42 of the pilot primary fuel injector 18.

The pilot secondary fuel injector 424 may include one or more heat shields in the form of thin walls separated from adjacent structure by an air space. The purpose of the heat shields is to protect the liquid fuel in the fuel manifold 470 from excessive heating and possible coking. In the illustrated example, the pilot secondary fuel injector 424 incorporates an annular inner heat shield 474, and an annular outer heat shield 476 radially outboard of the inner heat shield 474. The outer heat shield 476 defines the outer surface 462.

An annular inner wall 430 is disposed radially inboard of the inner heat shield 474. The inner wall 430 defines the inner surface 454.

A radial array of mid swirl vanes 436 defining a mid air swirler extends between the inner wall 430 and the inner heat shield 474. The mid swirl vanes 436 are shaped and oriented to induce a swirl into air flow passing through the mid air swirler. The mid swirl vanes 436 may be airfoil-shaped and may have a helical or partially-helical shape.

A radial array of outer swirl vanes 486 defining an outer air swirler extends between the outer surface 462 and the venturi 34. The outer swirl vanes 486 are shaped and oriented to induce a swirl into air flow passing through the outer air swirler. The outer swirl vanes 486 may be airfoil-shaped and may have a helical or partially-helical shape.

An inner air swirler comprises a radial array of inner swirl vanes 478 which extend between the pilot primary fuel injector 18 and the upstream section 456 of the inner surface 454 of the pilot secondary fuel injector 424. The inner swirl vanes 478 are shaped and oriented to induce a swirl into air flow passing through the inner air swirler. The inner swirl vanes 478 may be airfoil-shaped and may have a helical or partially-helical shape.

In this embodiment, the fuel flow from the fuel manifold 470 is surrounded by three pilot air flows (two inboard of the fuel manifold 470 and one outboard of the fuel manifold 470), as opposed to the two pilot air flows of the pilot secondary fuel injector 24 shown in FIGS. 1 and 2. The additional innermost air flow is useful in minimizing interaction of fuel sprays from the pilot primary fuel injector 18 and the pilot secondary fuel injector 424.

The fuel nozzle described above has several benefits. It employs dual fuel circuits—pressure atomizer pilot primary and air blast pilot secondary—to optimally meet engine light-off/starting performance and provide flame temperature control. Specifically, the dual fuel circuits in fuel nozzle are physically separated in both axial as well as radial positions to enable on-the-fly tailoring of fuel-air mixture at the pilot discharge. The physically separated pilot fuel circuits also impart variation in fuel residence times to impact emissions and flame temperature. Furthermore, the air blast secondary stage will not interfere with primary atomization as it is brought into operation.

The foregoing has described a fuel nozzle for a gas turbine engine. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends any novel one, or any novel combination, of the features disclosed in this specification (including any accompanying claims, abstract and drawings), or to any novel one, or any novel combination, of the steps of any method or process so disclosed.

What is claimed is:

1. A fuel nozzle apparatus for a gas turbine engine, comprising:

a first pilot fuel injector disposed on a centerline axis of the fuel nozzle which defines a direction of air flow through the fuel nozzle, the first pilot fuel injector being of a pressure atomizing type;

an annular second pilot fuel injector at least partially surrounding the first pilot fuel injector, the second pilot fuel injector being of an air blast type and having a fuel outlet disposed axially downstream and radially outboard of the first pilot fuel injector;

an annular venturi surrounding the first pilot fuel injector and the second pilot fuel injector, the venturi including a throat of minimum diameter, wherein the first pilot fuel injector and the annular second pilot fuel injector are in flow communication with a common channel defined by the venturi;

an array of inner swirl vanes extending between the first pilot fuel injector and the second pilot fuel injector;

an array of outer swirl vanes extending between the second pilot fuel injector and the venturi;

wherein the second pilot fuel injector includes an inner surface having, in axial sequence from front to rear: a generally cylindrical upstream section, a throat of minimum diameter, and a downstream diverging section; and wherein the second pilot fuel injector includes:

an annular fuel manifold defined therein which communicates with the fuel outlet;

an annular inner heat shield disposed radially inboard of the fuel manifold, separated from the fuel manifold by an air space;

an annular outer heat shield disposed radially outboard of the fuel manifold, separated from the fuel manifold by an air space;

an annular inner wall disposed radially inboard of the inner heat shield, the inner wall defining the inner surface; and an array of mid swirl vanes extending between the inner heat shield and the inner wall.

2. The apparatus of claim 1 further including:

a fuel system operable to supply a flow of liquid fuel at varying flowrates;

a first pilot fuel conduit coupled between the fuel system and the first pilot fuel injector;

a second pilot fuel conduit coupled between the fuel system and the second pilot fuel injector; and a main fuel conduit coupled between the fuel system and a main injection ring.

3. The apparatus of claim 1 wherein the second pilot fuel injector includes an outer surface having, in axial sequence from front to rear: a generally cylindrical upstream section, and a downstream converging section.

4. The apparatus of claim 1 wherein at least some of the array of inner swirl vanes, the array of outer swirl vanes, or the array of mid swirl vanes have a helical or partially-helical shape.

* * * * *